US005829212A

United States Patent [19]

McKeag et al.

[11] Patent Number: 5,829,212

[45] Date of Patent: Nov. 3, 1998

[54] BLAST-PROOF BUILDING

[75] Inventors: Robert James McKeag, Portadown, Ireland; Willaim H. Dickson, Belfast, United Kingdom; Trevor H Turkington, Portadown, United Kingdom; Robert Moore, Ballymena, United Kingdom; Thomas G Crymble, Lisburn, United Kingdom

[73] Assignee: J.H. Turkington & Sons (Contractors) Limited, Northern Ireland

[21] Appl. No.: 849,827

[22] PCT Filed: Dec. 14, 1995

[86] PCT No.: PCT/GB95/02916

§ 371 Date: Jun. 13, 1997

§ 102(e) Date: Jun. 13, 1997

[87] PCT Pub. No.: WO96/18787

PCT Pub. Date: Jun. 20, 1996

[30] Foreign Application Priority Data

Dec. 14, 1994 [GB] United Kingdom ..... 9425253

[51] Int. Cl.[6] ..... E04B 1/348

[52] U.S. Cl. ..... 52/236.3; 52/79.4; 52/79.9; 52/236.7; 52/236.9

[58] Field of Search ..... 52/236.3, 236.7, 52/236.9, 79.4, 79.9

[56] References Cited

U.S. PATENT DOCUMENTS

| | | | |
|---|---|---|---|
| 3,724,141 | 4/1973 | Kelleher | 52/79.4 X |
| 3,894,373 | 7/1975 | Willingham | 52/236.3 |
| 4,010,579 | 3/1977 | Galvagni | 52/79.9 X |
| 4,048,772 | 9/1977 | Gaul | 52/236.3 X |
| 5,081,805 | 1/1992 | Jazzar | 52/79.9 X |
| 5,491,942 | 2/1996 | Prokasky | 52/236.3 |

*Primary Examiner*—Christopher Kent
*Attorney, Agent, or Firm*—Edwin E. Greigg; Ronald E. Greigg

[57] ABSTRACT

A blast-proof building having one or more stories, each story comprising one or more rows of internal supports and having walls and a ceiling comprises of: (a) one or more intermediate "L" shaped components defining a wall portion and a ceiling portion, each corner of the free end of the-ceiling portion being carried by a support; (b) four or more corner components defining two wall portions and a co-joining ceiling portion, the free corner of the ceiling portion being carried by a support; and (c) one or more ceiling components for placement between each row of supports where there are a plurality of rows of supports; each component being secured to a neighboring component. The building meets the criteria of blast-proof protection, speed of erection, flexibility of size and demountability.

20 Claims, 4 Drawing Sheets

BLAST-PROOF BUILDING

PRIOR ART

This invention relates to a blast-proof building.

Buildings that are blast-proof to at least a certain extent against e.g. car-bombs, mortar and rocket attack, hereinafter termed "blast-proof buildings", are required in certain locations and/or for certain reasons, e.g. because of a terrorist threat. Such buildings must meet certain criteria, e.g. blast-proof protection, speed of erection. flexibility of size, demountability. One known building comprises a series of concrete cubes, suitably joined together. However, the maximum room size is constrained by the maximum size of cube possible. Also, construction and deconstruction can only be carried out cube by cube.

SUMMARY AND OBJECTS OF THE INVENTION

An object of the present invention is to obviate or mitigate these disadvantages, whilst still matching the required criteria.

According to one aspect of the present invention, there is provided a blast-proof building having one or more stories, or each storey comprising one or more rows of internal supports and having walls and a ceiling comprised of:

(a) one or more intermediate "L" shaped components defining a wall portion and a ceiling portion, each corner of the free end of the ceiling portion being carried by a support;

(b) four or more corner components defining two wall portions and a co-joining ceiling portion, the free corner of the ceiling portion being carried by a support and (c) one or more ceiling components for placement between each row of supports where there are a plurality of rows of supports;

each component being secured to its neighbouring components.

Thus the walls and ceiling of the building of the present invention are modular, i.e. easily and quickly constructable and deconstructable. Each component is preferably integral and precast, and thus immediately ready for erection. The size and number of rows of the supports and the size and number of each type of component may be varied over wide limits to provide substantial flexibility in the size and shape of the building. Moreover, as the components form a shell, they provide complete flexibility for any desired or necessary internal spacing arrangements. The internal division of space may be made e.g. by stud walls.

The supports are preferably stanchions. The supports can form the 'spines' of the building. Two rows of supports can be located symmetrically along the centre of the building to provide a frame for a corridor. Intermediate components extending from each row of such supports can provide room space on each side of the corridor.

Further rows of supports can be included to increase the size of the building. A multi-storey building may be formed by adding onto the ceiling of each storey the same components as described hereinbefore, with either supports of sufficient height or separate tiers of supports. If necessary or desired, further supports may be added to the building, e.g. to assist carrying the components or to assist division of any internal spacing requirement.

Access points, e.g. doors, can be included within the wall portions of either the intermediate components or the corner components. If necessary or desired, blastlocks can be included behind each access point.

Windows can also be included with the wall portions of either the intermediate components or the corner components. Preferably, the windows are replaceable by hardened blanks when not desired or necessary.

The inside of each portion of the ceiling, intermediate and corner components that form part of the outside of the building (some parts of which will not where there is a multi-storey building) may be steel-lined to prevent spalling of the inside of these outerwalls following a blast thereagainst, and thus to assist prevention of damage to the contents of the building.

Parts of some or all of the components may also have a double-skin construction comprising (steel) plates on both the outside and inside of such parts. The inside plate may be the spalling plate described above. Bolts or studs such as shear studs can connect the two plates. The outer plate(s) take at least some of the stress (upon impact of the building) normally taken by the inside plate(s). The double-skin construction is particularly suitable for use across the outside facing joints of the building, which may be its weakest points. Additional splice plates located over outside facing joints can connect the two outside plates of adjacent components, and can thus transfer stress across the break in the outer plates. Transferring stress across the break can assist preservation of the joint upon impact of the building.

At least some of the edges of the components, especially the major edges of intermediate and corner components, are preferably toothed or of a mortise and tenon configuration to assist securing them together. The relevant edges may have steel pieces thereon which have integral or welded teeth or mortise(s) and tenon(s). Above and below the joints splice plates may be welded.

More preferably, the relevant edges of the components have steel shear key plates thereon. The plates have two or more lines of parallel but intermittent teeth which interlock with complementary teeth on the relevant edge of an adjoining component to provide a reverse-action, intermittent halving joint. On each plate the teeth of each line preferably do not overlap with the teeth of adjacent line(s). The teeth of such a joint can be subjected to force in one direction only, i.e. they are not subjected to damaging stress reversal on any rebound of the components. Some components, possibly the final component(s) to be fitted, may only have one or more continuous outstanding edges needed to fit or slot between complementary edging on the adjacent components. Such complementary edging may be widened teeth.

The joints and any additional plates provide a portal framework so that a force on any component is transferred uniformly throughout the whole building, thereby distributing the force of any blast or impact. Extra plate(s) welded over the external part of each joint assist transverse distribution of any force.

A stand-off structure comprising a steel and mesh framework supporting a protective cover is preferably located around the whole building, with a berm, e.g. of concrete blocks, therearound. The building is preferably located on a pre-cast foundation to assist speed of erection. The building may be used to provide a secure base or housing, e.g. for essential or military equipment or soldiers.

According to a second aspect of the present invention, there is provided a blas-tproof building of one or more stories, the or each storey comprising one or more supports and either four corner components, each defining two wall portions and a co-joining ceiling portion, or two half-shell components defining between them the walls and ceiling of each storey, the supports carrying the ceiling portions of the components, and the components secured to their neighbour (s).

BRIEF DESCRIPTION OF THE DRAWINGS

Embodiments of the present invention will now be described by way of example only and with reference to the accompanying diagrammatic drawings in which.

DETAILED DESCRIPTION OF THE DRAWINGS

Figure 1:
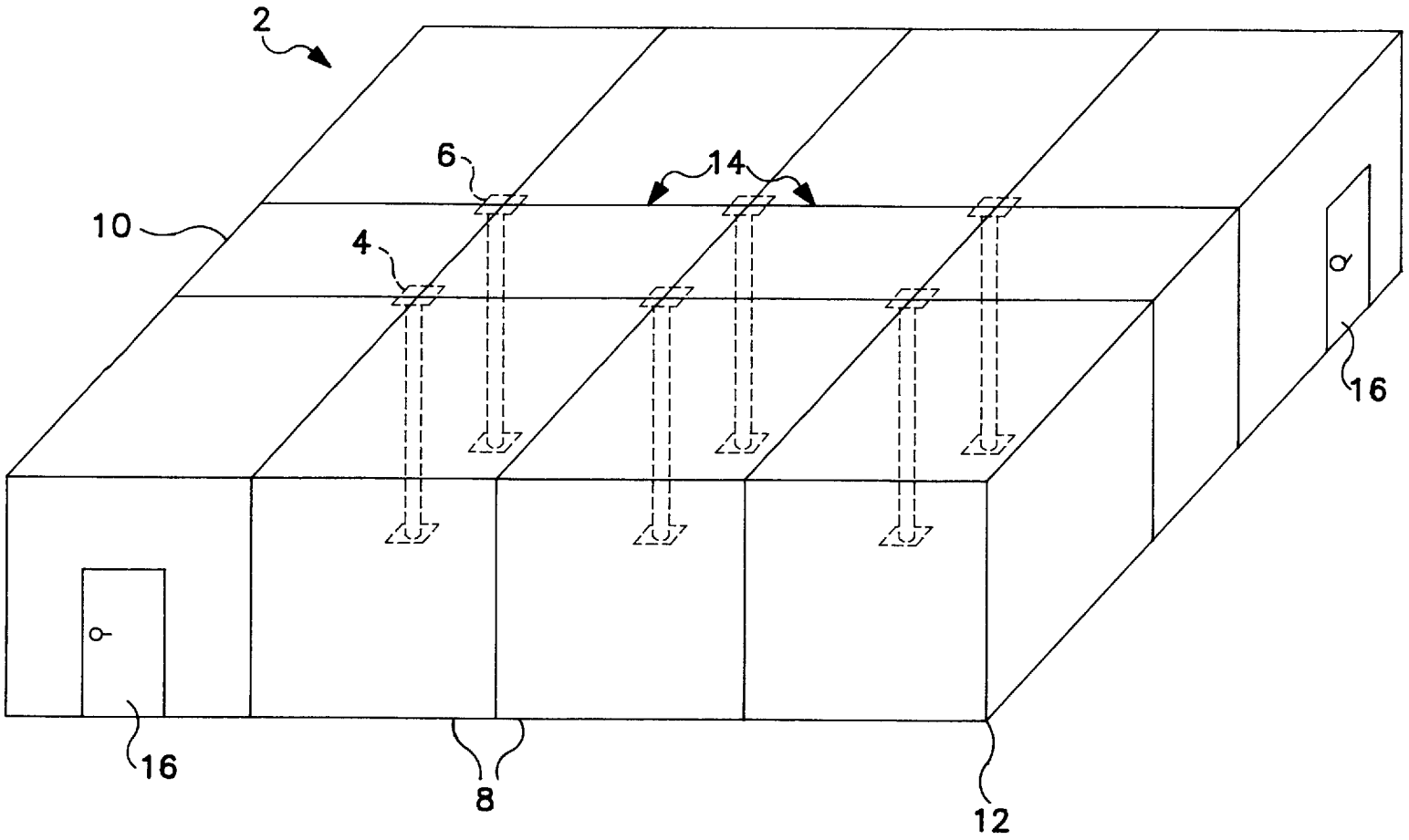
FIG. 1 is a perspective view of a building according to one embodiment of the present invention.

Referring to the drawings, FIG. 1 shows a single storey blast-proof building 2 having two rows of steel stanchions 4,6, around which there are:

(a) four "wide" intermediate "L" shaped components 8 and two "thin" intermediate "L" shaped components 10, the corners of the free ends of which are being carried by the stanchions 4,6;

(b) four corner components 12, the free corners of which are being carried by the corner stanchions 4,6; and (c) two ceiling components 14 between the stanchions 4,6, and being carried thereby.

The size and number of rows of stanchions 4,6, and the size and number of components 8,10,12,14 may be varied to create any sized building. The components 8,10,12,14 are pre-cast reinforced concrete, e.g. 300 mm thick. The layout of the stanchions 4,6 allows a corridor to be created thereby if desired.

Figure 4:
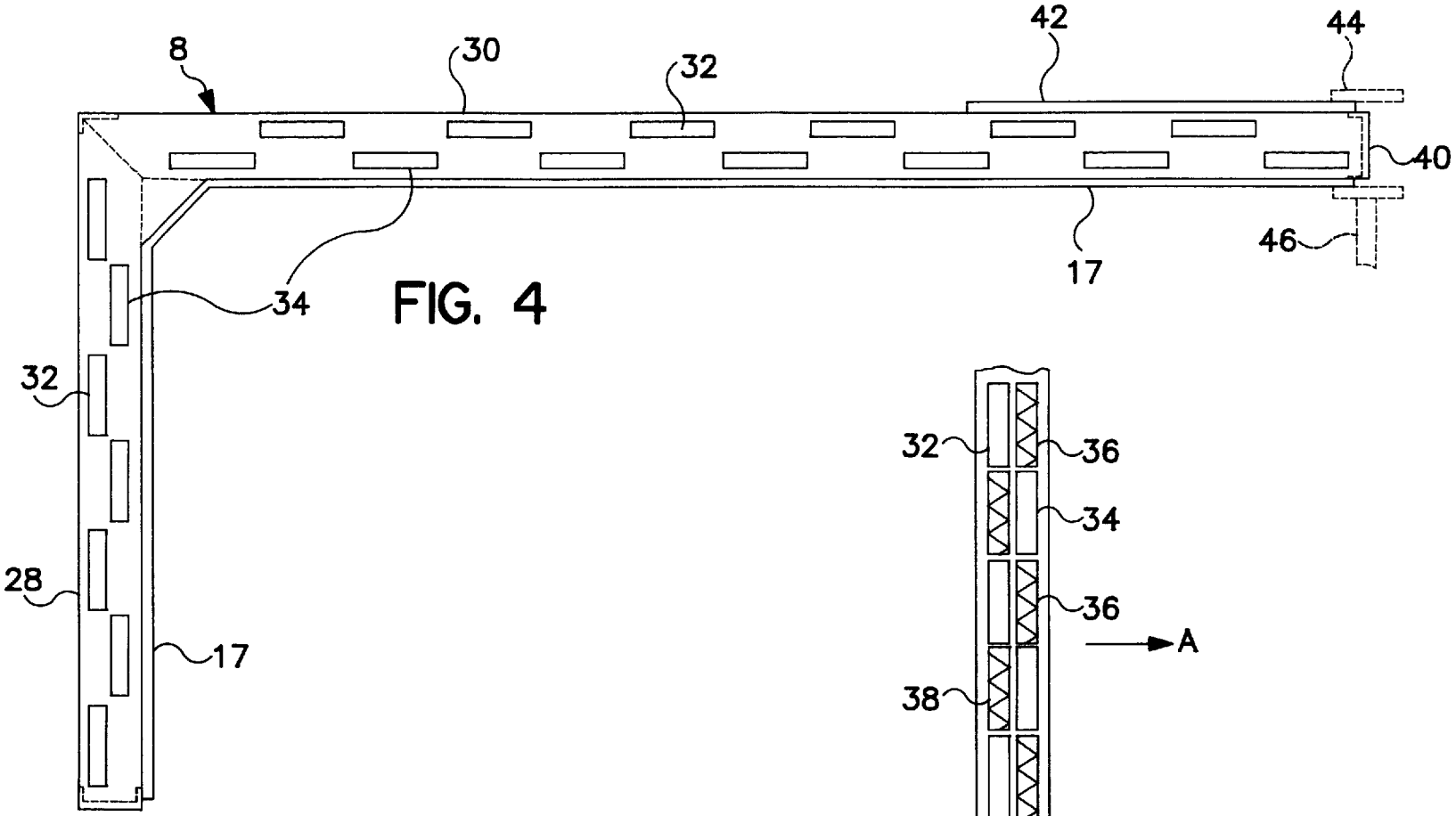
FIG. 4 is a side view of an intermediate component of a building of the present invention showing means for securing it to another component, and a double skin construction.

Each component 8,10,12,14 is secured to its neighbour, e.g. as shown in FIG. 4 herewith, and to the stanchions 4,6. Doors 16 in one of the wall portions of two of the corner components 12 provide access into the building 2.

Figure 2:
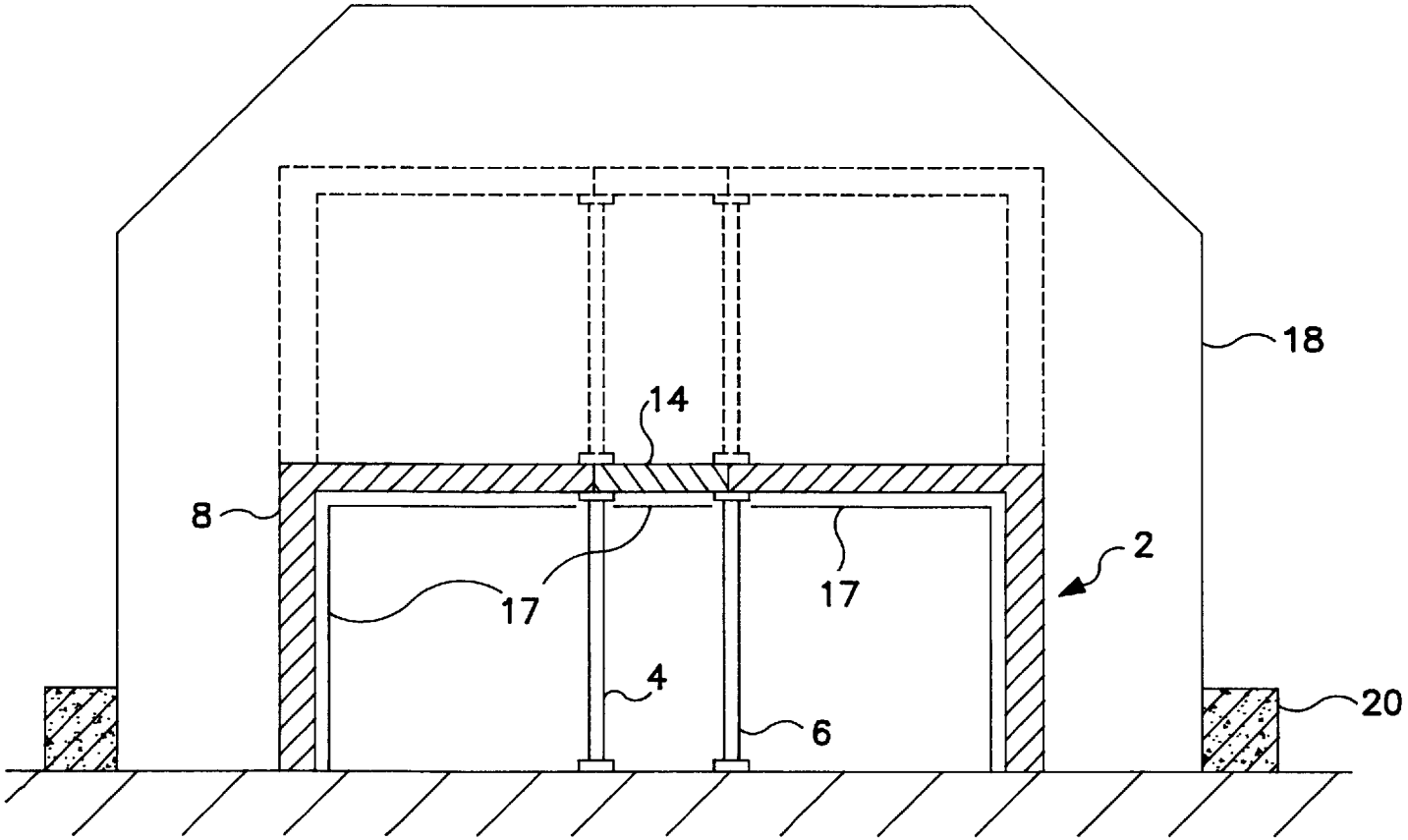
FIG. 2 is a cross-sectional side view of the building of FIG. 1 with a surrounding stand-off structure and berm.

In FIG. 2. the building 2 is surrounded by a stand-off structure 18 comprising a steel framework and mesh, supporting a plastic coated profile steel cover. The stand-off structure 18 is preferably one meter from the building 2, and may be in part supported thereby. The stand-off structure 18 is designed to absorb some of the kinetic energy of the force of a blast or a projectile thereagainst. A berm 20 of concrete blocks surrounds the base of the stand-off 18 to assist protection against e.g. car-bombs.

FIG. 2 also shows (diagrammatically) a steel lining 17 on the inside of components 8,14 to assist the prevention of spalling of the concrete sides of the components 8,14 upon any impact or blast against the building 2. The foundations for the building 2 et al in FIG. 2 are not shown. A possible second is shown in dotted line. The second story could comprise the same components as used for the ground floor, located on the ceiling of the ground floor. Each floor may have its own stanchions, or the stanchions may be twice as high.

Figure 3:
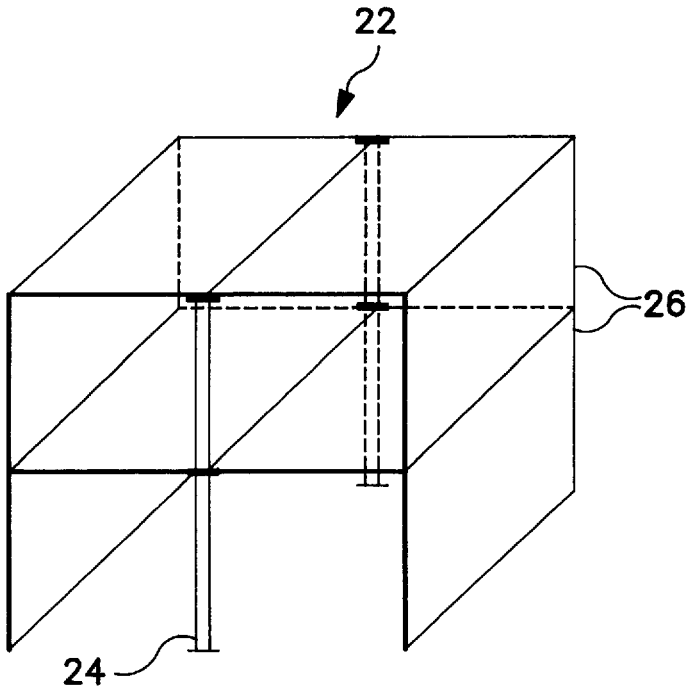
FIG. 3 is a cross-sectional perspective view of a building according to a second embodiment of the present invention.

FIG. 3 is a cross-sectional perspective view of a two story building 22 having one row of extended stanchions 24, and two layers of intermediate components 26 and corner components (not shown).

FIG. 4 is a side view of an intermediate component 8 of FIG. 1. Along the steel lined adjacent edges of the wall section 28 and the ceiling section 30 are two lines of parallel but intermittent teeth 32,34. The teeth 32,34 of each line do not overlap the teeth 32,34 of the other line. The edges of another intermediate component or corner component to be located against the first component 8 have two lines of complementary teeth such that the two components may be fitted slidingly together and the interlocking teeth form a reverse-action intermittent halving joint. On either or both sides of the joints steel plates may be fitted (e.g. welded) to shield the joint.

Figure 5:
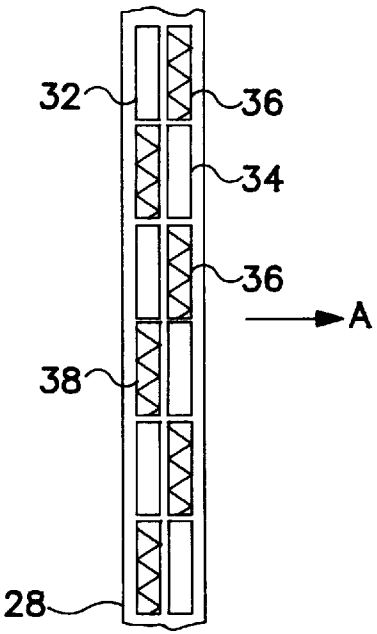
FIG. 5 is a part section of FIG. 4.

FIG. 5 shows a part section of the wall section 28 and teeth 32,34 with the complementary teeth 36, 38 (in shading) of an adjacent component. Any blast or impact on the building causing e.g. movement in direction A of the wall section 28 would create a force only on half of the teeth 36 of the next component, i.e. those behind first line of teeth 32. Any rebound of the wall section 28 would cause only the second line of teeth 34 to act on the other half of the teeth 38 of the next component. Force is therefore only possible in one direction on each tooth, such that damaging stress reversal is avoided.

The edges of the final component(s) to be fitted to a building of the present invention may have continuous outstanding edges designed to slot between edging as shown in FIG. 4 having a space between the lines of teeth.

The remaining edge 40 of the component 8 in FIG. 4 has a flat steel piece thereon. This edge 40 simply abuts a corresponding edge of another component. In the building 2 of FIG. 1, the ceiling components 14 may thus be simply lowered into place once the other components 8, 10, 12 are fitted together.

The component 8 in FIG. 4 also has an inner steel lining 17, and an outer steel lining 42 extending part-way from the 'remaining' edge 40. This part of the ceiling section 30 of the component 8 thus has a 'double skin' construction. The shear studs (not shown) that secure the inner lining 17 extend through the ceiling section 30 to secure the outer lining 42 also. The outer lining 42 is designed to take at least some of any stress or force acting on the inner lining 17. Once the 'remaining' edge 40 abuts an adjacent component, a steel plate 44 may be welded across the joint. The plate 44 not only provides some direct protection for the joint, but it can also transfer stress across the break in the outer plates 42. The inner lining 17 is welded to the top of a stanchion 46.

Variations and modifications can be made without departing from the scope of the invention described above.

The foregoing relates to preferred exemplary embodiments of the invention, it being understood that other variants and embodiments thereof are possible within the spirit and scope of the invention, the latter being defined by the appended claims.

What is claimed is:

1. A blast-proof building having one or more stories, each story comprising one or more rows of internal supports and an internal space having walls and a ceiling comprised of:

one or more intermediate "L"-shaped components defining a wall portion and a ceiling portion having corners and a free end, each corner of the free end of the ceiling portion being carried by a support;

four or more corner components defining two wall portions and a co-joining ceiling portion, a free corner of the co-joining ceiling portion being carried by a support; and one or more ceiling components for placement between each row of supports where there are a plurality of rows of supports;

each component being secured to a neighboring component.

2. A building as claimed in claim 1, wherein each component is integral and precast.

3. A building as claimed in claim 1, wherein the internal space of the building is divided by one or more walls.

4. A building as claimed in claim 1, wherein the supports are stanchions.

5. A building as claimed in claim 1 wherein two rows of supports are located symmetrically to provide a frame for a corridor.

6. A building as claimed in claim 1, which includes more than one story wherein each story apart from a ground floor story is located on a ceiling of a ground floor story and includes supports of a sufficient height for supporting all the stories as well as separate supports for each of the stories.

7. A building as claimed in claim 1, wherein the building includes at least one access point and includes at least one window replaceable by hardened blanks.

8. A building as claimed in claim 1, wherein an inside of one or more of the components has a lining to prevent spalling.

9. A building as claimed in claim 1, wherein at least a part of one or more of the components has a double-skin construction comprising outer and inner connected plates having joints therebetween and one or more of the joints between such components have a splice plate thereover to connect the outer plates of adjacent components.

10. A building as claimed in claim 8, wherein the lining is made from steel.

11. A building as claimed in claim 9, wherein the lining is made from steel.

12. A building as claimed in claim 1, wherein some of the edges of the components have a toothed configuration.

13. A building as claimed in claim 12, wherein said edges have steel pieces thereon to which the teeth are integral.

14. A building as claimed in claim 12, wherein the teeth on each steel piece are arranged in two or more parallel but intermittent lines adapted to interlock with complementary teeth on an adjacent component.

15. A building as claimed in claim 13, wherein the teeth on each steel piece are arranged in two or more parallel but intermittent lines adapted to interlock with complementary teeth on an adjacent component.

16. A building as claimed in claim 15, wherein on each plate the teeth of each line are not overlapped with the teeth of an adjacent line.

17. A building as claimed in claim 1, wherein a stand-off structure beam is located around the building.

18. A blast-proof building having at least one story, as claimed in claim 1, in which each story comprises only four corner components.

19. A blast-proof building as claimed in claim 1, comprising two half-shell components defining between them the walls and ceiling of a story, the supports carrying the ceiling portions of the components and the components are secured to an adjoining component.

20. A blast-proof building as claimed in claim 6, comprising two half-shell components defining between them the walls and ceiling of a story, the supports carrying the ceiling portions of the components and the components are secured to an adjoining component.

* * * * *